United States Patent [19]

Hix

[11] 4,264,666

[45] Apr. 28, 1981

[54] SYNTHETIC RESIN INTERLOCKING DIE CUT LETTERS FOR APPLICATION TO FABRIC BACKING

[75] Inventor: Clifford A. Hix, Pittsburg, Kans.

[73] Assignee: Hix Automation Incorporated, Pittsburgh, Kans.

[21] Appl. No.: 944,620

[22] Filed: Sep. 21, 1978

Related U.S. Application Data

[63] Continuation-in-part of Ser. No. 835,801, Sep. 21, 1977, abandoned.

[51] Int. Cl.[3] ..... G09F 7/16

[52] U.S. Cl. ..... 428/187; 40/586; 40/595; 428/195; 428/200

[58] Field of Search ..... D18/28; 40/618, 586–595; 428/195–200, 914, 187

[56] References Cited

U.S. PATENT DOCUMENTS

| | | | |
|---|---|---|---|
| 3,081,569 | 3/1963 | Ownbey | 40/618 |
| 3,270,452 | 9/1966 | D'Elia et al. | 40/618 |
| 3,537,202 | 11/1970 | Braun et al. | D18/28 X |
| 4,089,722 | 5/1978 | Holoubek | 428/200 X |
| 4,125,658 | 11/1978 | Miles | 428/131 |
| 4,157,412 | 6/1979 | Deneau | 428/147 |

*Primary Examiner*—Henry F. Epstein

*Attorney, Agent, or Firm*—Schmidt, Johnson, Hovey & Williams

[57] ABSTRACT

A script lettering system is provided using individual, die cut alphabet letter characters which are especially adapted for bonding to a fabric backing such as on a tee shirt. The letters are formed of material including synthetic resin substance and are configured for complemental, script-type interconnection in any desired order to form words or expressions, without the necessity of individually modifying the configuration of the letters. Additionally, the letters are formed and configured such that application of heat and pressure serves to bond the letters to a fabric backing, and also to render the synthetic resin substance of the letters partially flowable to thereby blend the originally discrete letters into a unified, integral expression and substantially eliminate lines of juncture between the letters. Each letter character preferably includes, adjacent the left- and righthand ends thereof when placed for normal left-to-right reading thereof, respective male and female interconnection surfaces which allow individual letters to be initially placed in adjacent, end-to-end relationship. This construction also facilitates smooth, aesthetically pleasing blending of the letters when the latter are subjected to heat and pressure. Both lower and upper case letters can be provided, and the letters can be cut using a variety of synthetic resin adhesive materials such as vinyl or acrylic material.

3 Claims, 6 Drawing Figures

SYNTHETIC RESIN INTERLOCKING DIE CUT LETTERS FOR APPLICATION TO FABRIC BACKING

This is a continuation-in-part of application Ser. No. 835,801, filed Sept. 21, 1977 and now abandoned.

BACKGROUND OF THE INVENTION

1. Field of the Invention

This invention relates to a system of interlocking die cut alphabet letter characters which are especially designed for allowing smooth, complemental script-type interconnection of the letters to form words or expressions on cloth backings with a complete absence of juncture lines between respective letters. More particularly, it is concerned with provision of individual script letters having, at the opposite ends thereof, interconnection surfaces allowing the letters to be placed in any desired order; the letters include synthetic resin material which can be rendered partially flowable, so that the letters can physically blend together to form a true script expression without unsightly juncture lines or the like.

2. Description of the Prior Art

Individual alphabet letters have long been provided for use in custom making of signs or decorations. Such letters have also been provided in all types of styles, e.g., block letters. In addition, it has been known to apply lettering or the like to cloth backing such as tee shirts. This is done in the case of decals, for example, by application of heat and pressure. However, when a script word or expression is desired, it is often necessary to custom print the same, by virtue of the fact that individual, mass produced script letter characters have not been available which can be smoothly and complementally interconnected in the traditional script fashion to yield an eye-pleasing final product. This is particularly the case with respect to lettering designed for bonding to cloth.

U.S. Pat. No. 3,081,569 describes individual script letters which are relatively large and designed for use in outdoor advertising. These letters are mechanically supported in use and are configured with complemental interfitting surfaces at the opposite ends thereof. However, these letters are not designed for application to a cloth backing and moreover are deficient in that characteristic juncture lines are present between individual letters.

Similarly, U.S. Pat. No. 3,270,452 describes relatively large, self-supporting letters having interconnection means at opposite ends thereof. Here again, the display letters of this patent are in no way suitable for application to a cloth backing.

SUMMARY OF THE INVENTION

The present invention particularly directed to provision of synthetic resin script-type letters which can be initially placed in a desired end-to-end orientation to form a word or expression, whereupon the letters can be treated (e.g., by heat and pressure) to render the resin forming the letters partially flowable and thereby cause the synthetic resin material of the letters to blend together to form an essentially unitary whole. Thus, although the letters as originally positioned show lines of juncture therebetween, treatment as aforesaid created a junction-free, eye appealing word or expression which is substantially the equivalent of hand lettering.

The individual letters can be die cut from a synthetic resin material such as a vinyl or acrylic which can be rendered partially flowable. The respective letters advantageously include, at the opposite ends thereof, interconnection surfaces (such as complemental concavo-convex surfaces) which allow the letters to be initially positioned in a desired order on a cloth backing or the like. Thus, application of heat and pressure to the initially positioned letters serves to blend the adjacent interconnection surfaces thereof and create, in effect, an integral word or expression bound to the cloth backing.

DESCRIPTION OF THE PREFERRED EMBODIMENT

Figure 1:
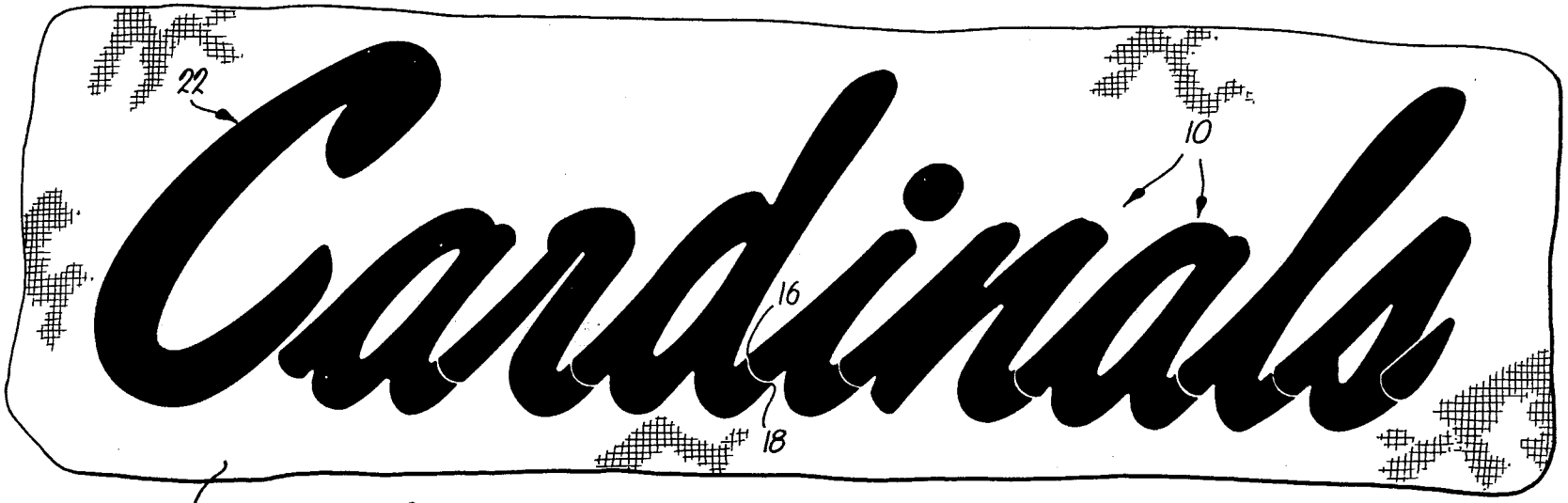
FIG. 1 is a plan view of a number of individual cut letters in accordance with the invention, used to initially form an illustrative word on a tee shirt.

Referring now to the drawings, the word "Cardinals" is illustrated in FIG. 1, as it would appear when initially formed from individual die cut letters in accordance with the invention. The letters are arranged on a conventional tee shirt front A. Each individual letter 10 is in script form and represents one of the twenty-six letters of the alphabet. The letters are cut from a selected material such as a normally solid synthetic resin material which can be rendered at least partially flowable to integrate the individual letters as will be explained.

A wide variety of specific materials can be used for the letters hereof. For example, a plastisol vinyl adhesive can be applied to a strippable paper backing; the individual letters can then be cut and applied to a cloth backing using heat and pressure, whereupon the paper can be stripped to reveal the final, blended, synthetic resin letters. Such vinyl adhesive materials are conventional and can be purchased from companies such as International Castings, Rutland Plastics or Colonial Printing Ink Co. As another example, a two ply material having a mylar sheet coated with a polyester adhesive can be used. Such a material is sold by the Old Dominion Oil Company under the designation "Prisma." A rayon-flocked laminar material believed to include a rayon flock, a polyurethane flock adhesive, and a polyester adhesive can also be employed. Such flocked material can be purchased from Wasserstein Bros. Inc., New York, New York. In all of the above examples, the synthetic resin material component is normally solid but can be rendered at least partially flowable by application of heat and pressure. This serves to blend the letters and also bond the latter to the appropriate backing.

Figure 2:
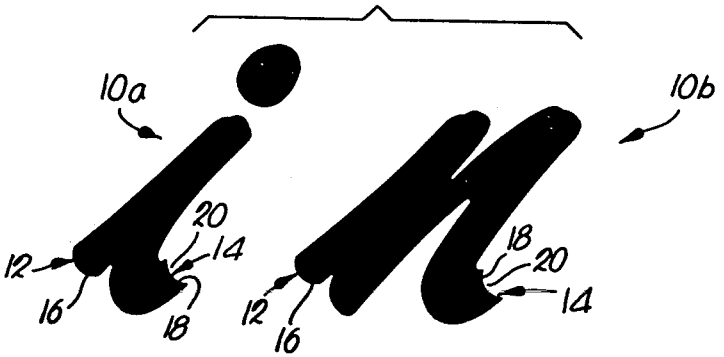
FIG. 2 is a view illustrating two letters in accordance with the invention, "i" "n", prior to interconnection thereof.
Figure 6:
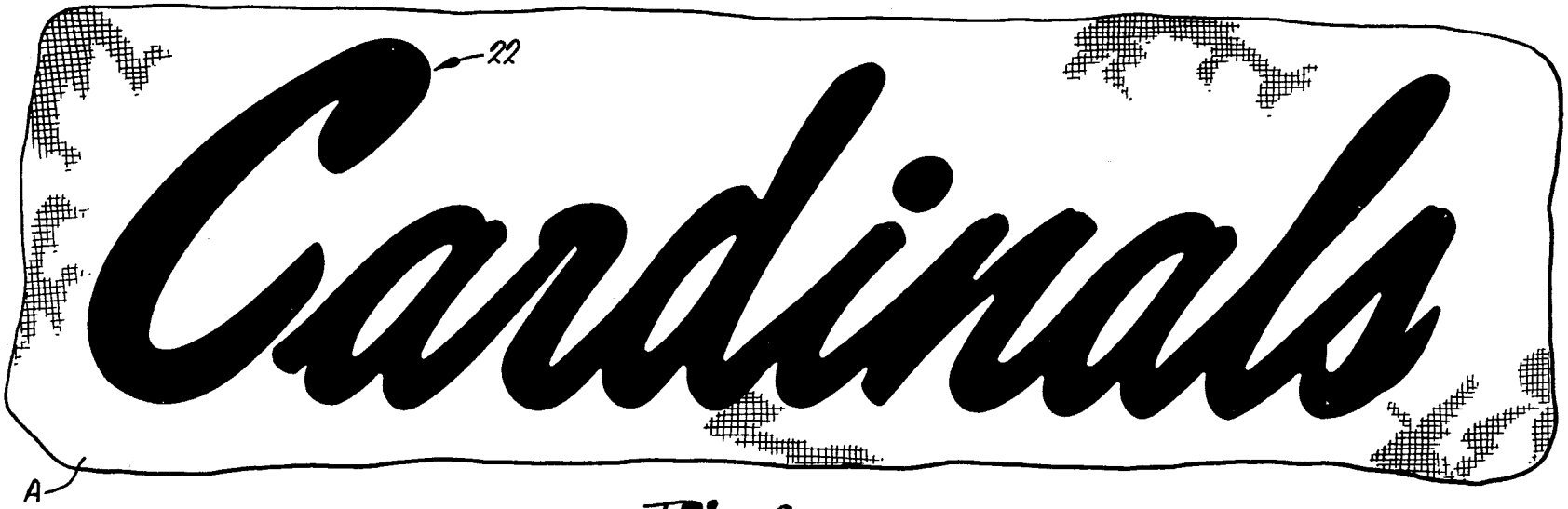
FIG. 6 is a plan view similar to FIG. 1 but depicting the integrated, junction-free nature of the illustrative word after application of heat and pressure.

The respective letters can be placed in any desired end-to-end relationship for forming words or expressions, and in this regard the word depicted in FIG. 1 is presented for purposes of illustration only. Referring more particularly to FIG. 2, the letters "i" and "n" respectively numbered 10*a* and 10*b*, are shown prior to initial script-type interconnection thereof. Each letter includes, adjacent the left- and righthand ends thereof when viewed for normal left-to-right reading, respective interconnection surfaces 12 and 14. The surface 12 is in the form of an arcuate, convex, projecting male connection surface 16. The latter projects outwardly in a direction generally away from the main body of the corresponding letter character, as will be readily seen. On the other hand, the remaining interconnection surface 14 preferably is in the form of an arcuate, concave, female connection surface 18 which in effect extends inwardly in a direction generally toward the main body of the corresponding letter. The surface 18 defines a relatively shallow recess 20 which is designed for complementally receiving the projecting male surface 16 of an adjacent letter character and effecting initial script-type interconnection thereof. Thus, the separated letters in FIG. 2 can be seen in the expression "Cardinalsl" of FIG. 1 as initially positioned and interconnected. Similarly, all of the other lower case letters in the expression are similarly interconnected. It will be noted however, that the initial positioning of the letters on the tee shirt leaves unsightly curved lines of juncture between adjacent letters.

An upper case letter "C", 22, is the first letter of the depicted expression and is not provided with a complemental interconnection surface for actual interconnection to the remaining lower case letters; however, it will be readily appreciated that the letter "C" could be so designed, and that a system in accordance with the invention embodying only upper case letters could also be provided.

Figure 3:
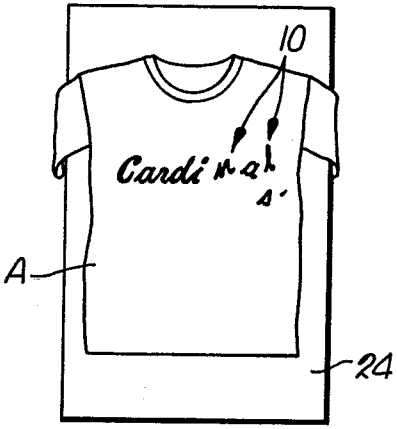
FIG. 3 is a plan view of a tee shirt during placement of the individual letters thereon prior to completion of the initial letter orientation illustrated in FIG. 1.

Turning now to FIGS. 3–6, the preferred method of use of the letters of the invention is illustrated. First, the tee shirt A is placed on an appropriate planar support 24 (FIG. 3). At this point individual letters as described above are placed across the front of the tee shirt to form a desired word or expression, in order to give an initial positioning of the letters as depicted in FIG. 1. In FIG. 3 the individual letters are shown during the manual positioning process.

Figure 5:
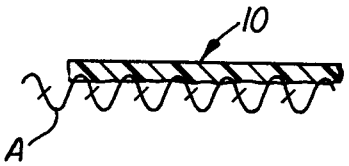
FIG. 5 is an enlarged, fragmentary sectional view depicting the integrated condition of a pair of originally discrete letters in accordance with the invention.
Figure 4:
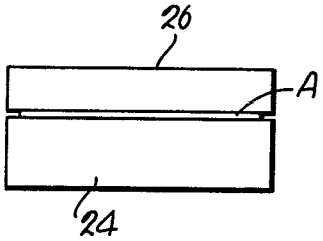
FIG. 4 is a schematic view illustrating a process wherein a platen is used to apply heat and pressure to the individual letters positioned on the tee shirt of FIG. 3, in order to blend the individual letters at areas of interconnection thereof and bond the letters to the tee shirt.

The next step involves treating the initially arranged letters to render the synthetic resin material thereof at least partially flowable in order to blend the letters. Normally, this is accomplished through the use of a platen 26 (see FIG. 4) which is designed for applying heat and pressure to the letters 10. Use of such a platen is well known in the art and need not be described in detail. This heat and pressure treatment is continued for a sufficient time to allow the complemental interconnection surfaces of adjacent letters 10 to flow together and blend, to thereby substantially eliminate the noted lines of juncture between the individual letters. As shown in FIG. 5, this process serves to integrate the letters at their respective interconnection surfaces to thereby give a unified expression on the cloth of the tee shirt. At the same time, as shown in FIG. 5, the application of heat and pressure serves to bond the letters to the tee shirt A. Upon completion of the heat and pressure treatment, tee shirt A can be removed, allowed to cool, and is then ready for shipping or use.

It should be understood that the particular type of interconnection surfaces herein described, i.e., concavo-convex surfaces, are particularly suited for facilitating the described blending of the individual letters upon application of heat and pressure. However, other types of interconnection surfaces can also be employed, as long as the letters can be blended to produce an essentially integrated and unitary word or expression on a cloth backing.

Having thus described the invention, what is claimed as new and desired to be secured by Letters Patent is:

1. The invention comprising:

a plurality of separate alphabet letter characters formed of thin, normally solid synthetic resin sheet-like material which can be rendered at least partially flowable, said letters being configured for placement in any desired order and in an end-to-end relationship for forming words or expressions, each of said letter characters being configured to present, adjacent the left- and right-hand ends thereof when placed for normal left-to-right reading of the letter character, respective interconnection surfaces for complemental script-type interconnection of a plurality of the letter characters in said end-to-end relationship to form a word or expression on a cloth backing, said interconnection surfaces including a male connection surface at one end of each letter character, and a complemental female connection surface adjacent the remaining end of the letter character, the complemental interconnection surfaces of separate letter characters being configured for blending together by virtue of physical flowing together of said material adjacent said surfaces, when said letter characters are interconnected and said material is rendered partially flowable, for substantially eliminating any lines of juncture between said letter characters in said word or expression and creating a substantially integrated and unified word or expression, said material having the property of bonding to said cloth backing when the material is rendered partially flowable for securing said word or expression to the backing simultaneously with said blending together of said interconnection surfaces.

2. The invention as set forth in claim 1 wherein said male interconnection surface includes an arcuate endmost male surface which projects outwardly in a direction generally away from the main body of the letter character, and wherein said female interconnection surface includes an arcuate endmost female surface which extends inwardly in a direction generally toward the main body of the letter character and presents a recess for complementally receiving the endmost male surface of another of said letter characters when placed in adjacent, end-to-end relationship to said letter character.

3. The invention as set forth in claim 1 wherein said letter characters are cut in the form of script-type lower case letters.

* * * * *